US008981999B2

(12) United States Patent
Liu et al.

(10) Patent No.: US 8,981,999 B2
(45) Date of Patent: Mar. 17, 2015

(54) BROADBAND ANTENNA ELEMENT

(71) Applicants: Chien-Chang Liu, New Taipei (TW); Yen-Hui Lin, New Taipei (TW)

(72) Inventors: Chien-Chang Liu, New Taipei (TW); Yen-Hui Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 95 days.

(21) Appl. No.: 13/689,782

(22) Filed: Nov. 30, 2012

(65) Prior Publication Data

US 2014/0055318 A1 Feb. 27, 2014

(30) Foreign Application Priority Data

Aug. 27, 2012 (CN) ..... 101131081

(51) Int. Cl.
*H01Q 1/38* (2006.01)
*H01Q 21/00* (2006.01)

(52) U.S. Cl.
CPC ..... *H01Q 21/00* (2013.01)
USPC ..... 343/700 MS; 343/795

(58) Field of Classification Search
USPC ..... 343/700 MS, 702, 795
See application file for complete search history.

(56) References Cited

U.S. PATENT DOCUMENTS

| | | | | |
|---|---|---|---|---|
| 5,861,854 | A * | 1/1999 | Kawahata et al. | 343/702 |
| 6,614,398 | B2 * | 9/2003 | Kushihi et al. | 343/700 MS |
| 7,471,252 | B2 * | 12/2008 | Onaka et al. | 343/702 |
| 2005/0078037 | A1 * | 4/2005 | Leclerc et al. | 343/702 |
| 2006/0017621 | A1 * | 1/2006 | Okawara et al. | 343/700 MS |
| 2006/0244665 | A1 * | 11/2006 | Tung | 343/702 |

* cited by examiner

*Primary Examiner* — Tan Ho
(74) *Attorney, Agent, or Firm* — Novak Druce Connolly Bove + Quigg LLP

(57) ABSTRACT

A broadband antenna element includes a circuit board, an antenna carrier connected to the circuit board, and a broadband antenna. The broadband antenna includes a first antenna and a second antenna which are conductive bent strips of metal. The first antenna includes a first feed terminal and a second feed terminal. The second antenna includes a third feed terminal and a coupling ground terminal. The second feed terminal and the coupling ground terminal are mounted on the circuit board keeping a first predetermined distance away from each other. The first feed terminal is mounted on the antenna carrier/circuit board being connected to the second feed terminal, and the third feed terminal is mounted on the antenna carrier being connected to the coupling ground terminal.

9 Claims, 4 Drawing Sheets

BROADBAND ANTENNA ELEMENT

BACKGROUND

1. Technical Field

The present disclosure relates to broadband antenna elements.

2. Description of the Related Art

A remote communication apparatus integrates various communicating modes, such as GSM, WCDMA, and LTE, to expand the available modes of communication, which results in increasing the broadband of an antenna of the apparatus. However, the broadband antenna of related art has limits which can not be expanded easily.

Therefore, there is room for improvement within the art.

BRIEF DESCRIPTION OF THE DRAWINGS

The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
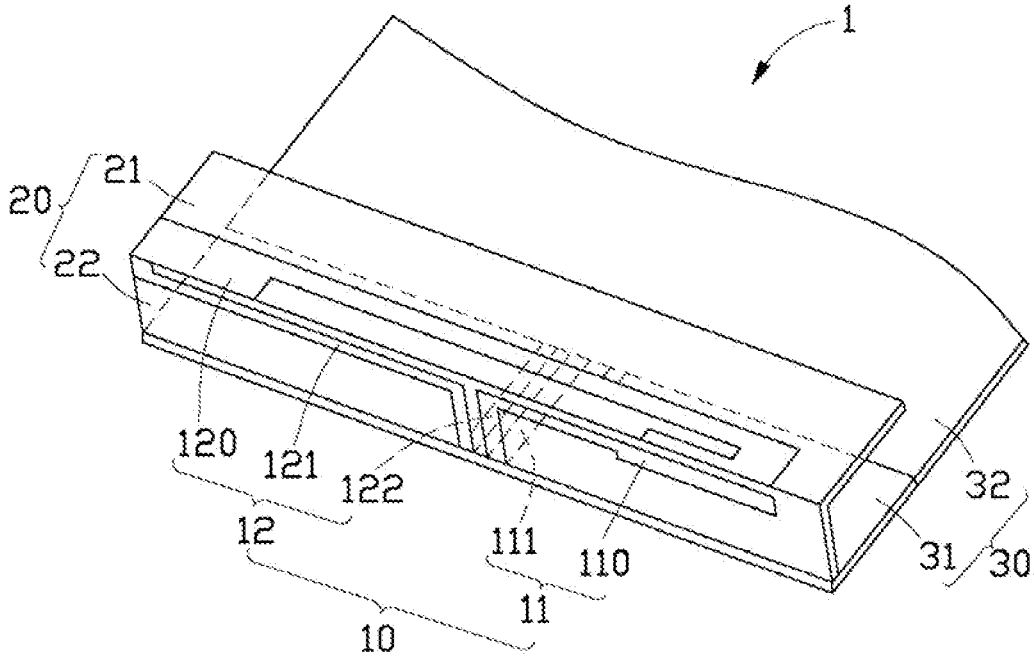
FIG. 1 is a partially sectioned schematic view of a broadband antenna element, according to an exemplary embodiment.
Figure 2:
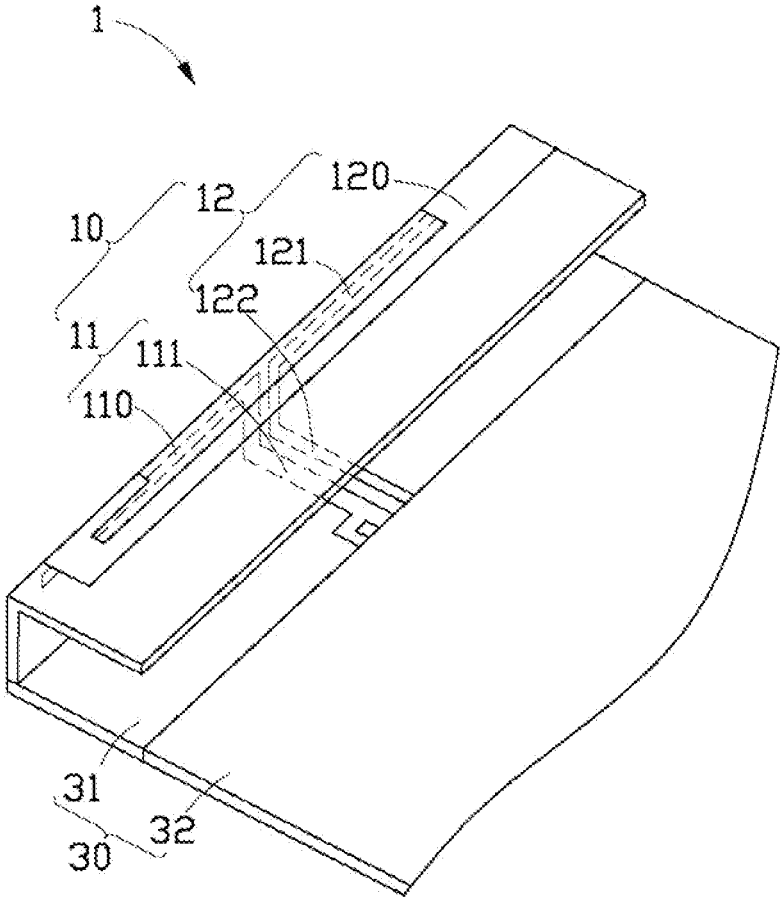
FIG. 2 is a partially sectioned schematic view of the broadband antenna element of FIG. 1, but viewed from another aspect.

Referring to FIGS. 1 and 2, a broadband antenna element 1 includes a broadband antenna 10, an antenna carrier 20 and a circuit board 30. The broadband antenna 10 is mounted on the antenna carrier 20. The circuit board 30 includes a first region 31 electrically connected to the broadband antenna 10, a second region 32 is grounded. The first region 31 and the second region 32 are on the same plane.

The antenna carrier 20 includes a first plate portion 21 and a second plate portion 22. The first plate portion 21 is substantially parallel with the circuit board 30, and the second plate portion 22 is substantially perpendicular to the circuit board 30 and connected to the edge of the first region 31. The broadband antenna 10 includes a first antenna 11 and a second antenna 12. The first antenna 11 and the second antenna 12 are both conductive, formed by bending metal strips. Each of the first antenna 11 and the second antenna 12 includes a connecting terminal and a feed terminal.

Figure 3:
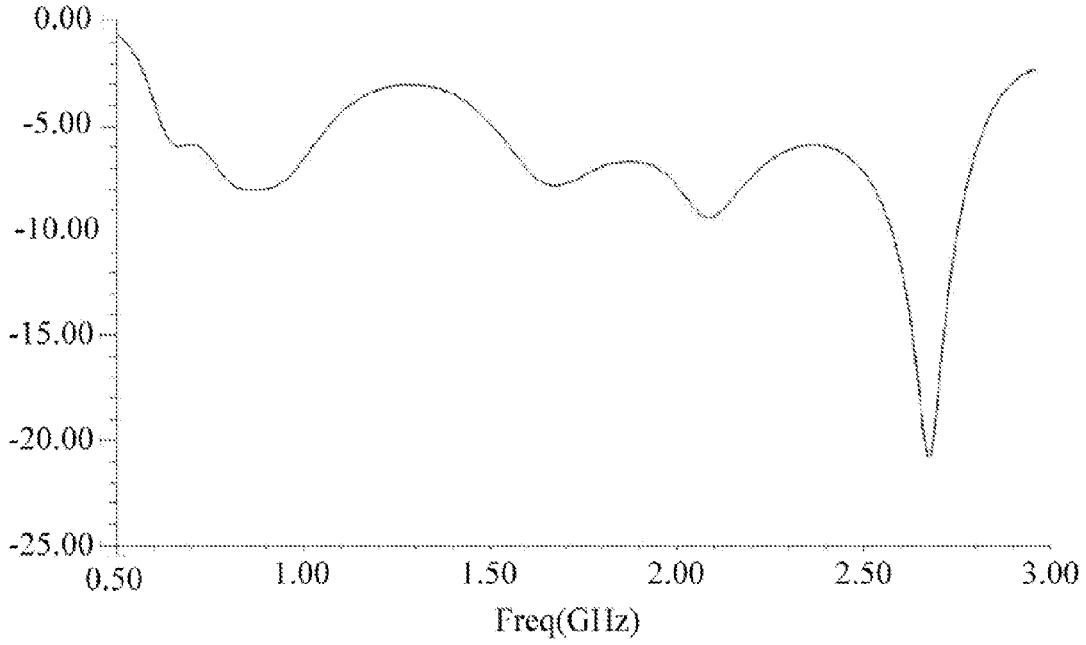
FIG. 3 is an exemplary return loss waveform of the broadband antenna element.

The first antenna 11 includes a first feed terminal 110 and a second feed terminal 111. The first feed terminal 110 is mounted on the second plate portion 22, and the second feed terminal 111 is mounted in the first region 31 with an end connected to the first feed terminal 110 and the other end connected to the second region 32. The second antenna 12 includes a third feed terminal 120, a fourth feed terminal 121, and a coupling ground terminal 122. The third feed terminal 120 is mounted on the first plate portion 21. In the embodiment, the third feed terminal 120 is mounted on an edge where the first plate portion 21 adjoins the second plate portion 22. The fourth feed terminal 121 is mounted on the second plate portion 22 at a first predetermined distance from the first feed terminal 110. The coupling ground terminal 122 is mounted on the first region 31. The fourth feed terminal 121 is connected between the third feed terminal 120 and an end of the coupling ground terminal 122. The other end of the coupling ground terminal 122 is connected to the second region 32 at a second predetermined distance from the second feed terminal 111. In the embodiment, the coupling ground terminal 122 is substantially parallel to the second feed terminal 111, and the fourth feed terminal 121 is substantially parallel to the first feed terminal 110 and perpendicular to both the second feed terminal 111 and to the coupling ground terminal 122, which results in the first predetermined distance being substantially equal to the second predetermined distance. Thereby, a first low impedance of the broadband antenna 10 is generated in the second predetermined distance, a second low impedance of the broadband antenna 10 is generated on the distal terminal of the first feed terminal 110, and a high impedance of the broadband antenna 10 is generated in the first predetermined distance. Each of the first predetermined distance and the second predetermined distance can be adjusted to change the impedance of the broadband antenna 10 accordingly (as shown in FIG. 3).

Figure 4:
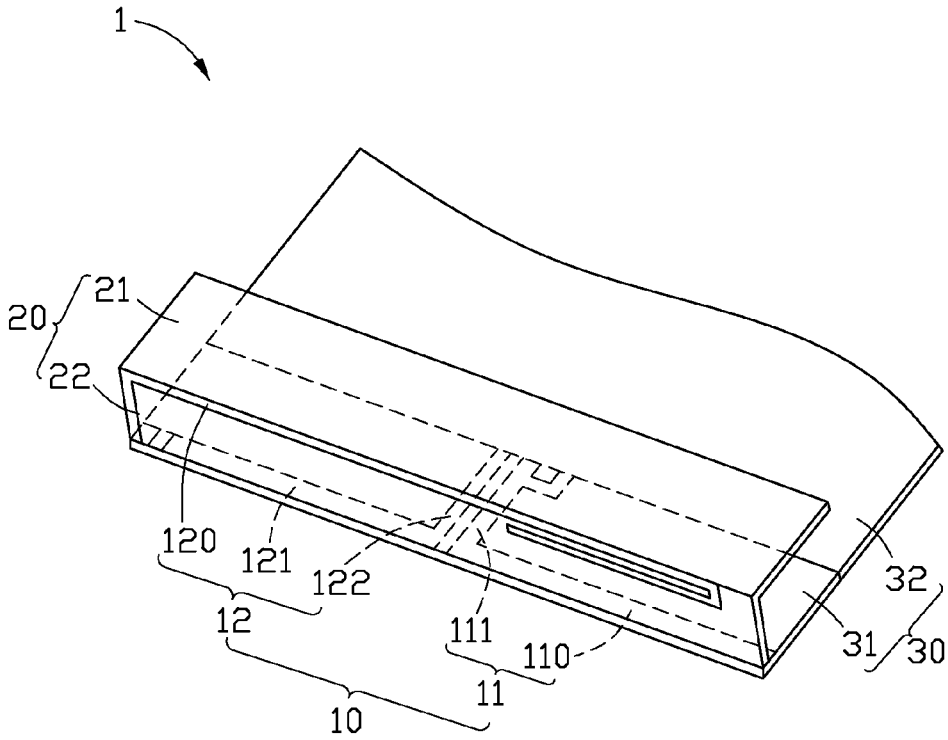
FIG. 4 is a partially sectioned schematic view of the broadband antenna element, according to another exemplary embodiment.

Referring to FIG. 4, in an alternative embodiment, the first feed terminal 110 and the second feed terminal 111 are mounted on the first region 31. The first feed terminal 110 is mounted on an edge of the first region 31 and perpendicular to the second feed terminal 111, thus the first antenna 11 is "L" shaped. The third feed terminal 120 is mounted on the second plate portion 22, and the fourth feed terminal 121 and the coupling ground terminal 122 are mounted on the first region 31. The fourth feed terminal 121 is mounted on an edge of the first region 31 and perpendicular to the coupling ground terminal 122, thus the second antenna 12 is also "L" shaped. The fourth feed terminal 121 is connected between the third feed terminal 120 and the coupling ground terminal 122. The second feed terminal 111 maintains the predetermined distance from the coupling ground terminal 122. In the embodiment, the second feed terminal 111 is substantially parallel to the coupling ground terminal 122.

In the embodiment, the first feed terminal 110, the second feed terminal 111, the fourth feed terminal 121, and the coupling ground terminal 122 are formed in the first region 31 of the circuit board 30 using an etching process. In the embodiment, a circuit module 40 is electronically connected to the fourth feed terminal 121, which is configured for processing wireless signals received/transmitted by the third feed terminal 120.

The present disclosure may be embodied in other forms without departing from the spirit thereof. The present examples and embodiments are to be considered in all respects as illustrative and not restrictive, and the disclosure is not to be limited to the details given herein.

What is claimed is:

1. A broadband antenna element comprising:

a circuit board;

an antenna carrier connected to the circuit board; and a broadband antenna comprising a first antenna and a second antenna which are conduction circuits formed by bending pieces of strip metal, wherein the first antenna comprises a first feed terminal and a second feed terminal, the second antenna comprises a third feed terminal, a fourth feed terminal and a coupling ground terminal, the second feed terminal and the coupling ground terminal are mounted on the circuit board keeping a first predetermined distance away from each other, the first feed terminal is mounted on the antenna carrier or the circuit board and connected to the second feed terminal, and the third feed terminal is mounted on the antenna carrier and connected to the coupling ground terminal, the fourth feed terminal is mounted on the antenna carrier or the circuit board and connected between the third feed terminal and an end of the coupling ground terminal.

2. The broadband antenna element as recited in claim 1, wherein the antenna carrier comprises a first plate portion parallel with the circuit board and a second plate portion perpendicular to the circuit board and connected to an edge of the circuit board.

3. The broadband antenna element as recited in claim 2, wherein the first feed terminal is mounted on the second plate portion, and the second feed terminal is mounted on the circuit board with an end thereof being connected to the first feed terminal; the third feed terminal is mounted on the first plate portion, the fourth feed terminal is mounted on the second plate portion keeping the first predetermined distance away from the first feed terminal, the coupling ground terminal is mounted on the circuit board, the other end of the coupling ground terminal is connected to the circuit board keeping a second predetermined distance away from the second feed terminal.

4. The broadband antenna element as recited in claim 3, wherein the third feed terminal is mounted on an edge where the first plate portion adjoins the second plate portion.

5. The broadband antenna element as recited in claim 3, wherein the second feed terminal is parallel with the coupling ground terminal, the fourth feed terminal is parallel with the first feed terminal and perpendicular to the second feed terminal and the coupling ground terminal, and the first predetermined distance is substantially equal to the second predetermined distance.

6. The broadband antenna element as recited in claim 1, wherein the first feed terminal and the second feed terminal are mounted on the circuit board, the third feed terminal are mounted on the second plate portion, the fourth feed terminal and the coupling ground terminal are mounted on the circuit board.

7. The broadband antenna element as recited in claim 6, wherein the first feed terminal is mounted on an edge of the second plate portion where the second plate portion is connected to the circuit board perpendicular to the second feed terminal, the fourth feed terminal is mounted on an edge where the second plate portion is connected to the circuit board perpendicular to the coupling ground terminal.

8. The broadband antenna element as recited in claim 6, wherein the first feed terminal, the second feed terminal, the third feed terminal, and the coupling ground terminal are formed on the circuit board using an etching process.

9. The broadband antenna element as recited in claim 6, further comprising a circuit module mounted on the fourth feed terminal, wherein the circuit module is configured to process wireless signals received/transmitted by the third feed terminal.

* * * * *